US009376846B2

(12) United States Patent
Aral

(10) Patent No.: US 9,376,846 B2
(45) Date of Patent: Jun. 28, 2016

(54) CONCEALED HINGE MECHANISM

(71) Applicant: Vedat Aral, Irvine, CA (US)

(72) Inventor: Vedat Aral, Irvine, CA (US)

( * ) Notice: Subject to any disclaimer, the term of this patent is extended or adjusted under 35 U.S.C. 154(b) by 0 days.

(21) Appl. No.: 14/161,605

(22) Filed: Jan. 22, 2014

(65) Prior Publication Data

US 2015/0204124 A1 Jul. 23, 2015

(51) Int. Cl.
*E05D 7/00* (2006.01)
*E05D 3/06* (2006.01)

(52) U.S. Cl.
CPC .. *E05D 7/00* (2013.01); *E05D 3/06* (2013.01); *E05Y 2600/41* (2013.01); *Y10T 16/5472* (2015.01)

(58) Field of Classification Search
CPC ..... E05D 3/06; E05D 3/12; E05D 3/18; E05D 5/0276; E05D 5/04; E05D 7/00; E05D 7/125; E05D 7/0407; E05Y 2600/41; E05Y 2900/132; Y10T 16/5472; Y10T 16/547; Y10T 16/5525; Y10T 16/53864; Y10T 16/554; Y10T 16/558
USPC ..... 16/367, 366, 379, 302, 382, 387; 49/398
See application file for complete search history.

(56) References Cited

U.S. PATENT DOCUMENTS

| | | | | | |
|---|---|---|---|---|---|
| RE15,934 | E | * | 10/1924 | Mastenbrook | 16/262 |
| 1,887,549 | A | * | 11/1932 | Ervin | 16/367 |
| 1,903,379 | A | * | 4/1933 | Hall | 16/367 |
| 2,071,070 | A | * | 2/1937 | Horst | 16/357 |
| 2,073,689 | A | * | 3/1937 | Gotzinger | 16/358 |
| 2,112,472 | A | * | 3/1938 | Shawcross | 16/364 |
| 2,217,937 | A | * | 10/1940 | Anderson | 16/379 |
| 3,523,323 | A | * | 8/1970 | Jorgensen | 16/302 |
| 3,978,549 | A | * | 9/1976 | Vitt | 16/245 |
| 4,692,964 | A | * | 9/1987 | DeBruyn | 16/367 |
| 5,075,928 | A | * | 12/1991 | Bobrowski | 16/273 |
| 5,282,293 | A | * | 2/1994 | Pedoeem | 16/342 |
| 2010/0115729 | A1 | * | 5/2010 | Neukoetter | 16/235 |

* cited by examiner

*Primary Examiner* — William Miller
(74) *Attorney, Agent, or Firm* — Eric Karich; Karich & Associates

(57) ABSTRACT

A concealed hinge mechanism for connecting a door and a door frame has two fixed plates mounted on the door and the door frame, and two L-shaped connecting elements to connect the fixed plates while providing a rotational and outward movement for opening.

6 Claims, 19 Drawing Sheets

CONCEALED HINGE MECHANISM

BACKGROUND OF THE INVENTION

1. Field of the Invention

The present invention relates to a concealed hinge mechanism mounted on a door frame and a door and more particularly to the concealed hinge mechanism concealed from outside view when the door is closed.

2. Description of Related Art

Conventional hinges are known in the art providing rotational opening to a door relative to the door frame. A typical hinge consists of two plates in which the first plate is mounted to the vertical edge of the door and the second one mounted to the vertical edge of the door frame. The plates ending with a vertical knuckle are connected with a hinge pin inserted into the knuckles. The benefits of that simple mechanism are easy manufacturing, easy installation and low cost. But the hinge elements—knuckles and the hinge pin—are exposed and accessible from the outside when the hinge is installed in a way to provide outward opening which causes security and aesthetic problems. Exposed elements can be tampered even-though the door is locked.

To eliminate those issues the conventional hinge can be installed internally. But this installation method provides inward opening only.

Also, concealed hinges are known in the art to eliminate exposing the hinge parts to provide security and aesthetic benefits. The problem with the existing concealed hinges is that some parts of the mechanism have to be placed into the cavities of the door and/or door frame. The alteration of the door and/or door frame requires additional tools and skill set. Fixing or replacing the incorrectly altered material can be time consuming and costly. Also the existing concealed hinge mechanisms comprise many parts require complex and costly manufacturing techniques.

SUMMARY OF THE INVENTION

The object of the present invention is to provide a concealed hinge mechanism that can be installed similar to a conventional hinge which requires no cavities or alterations on the door and/or door frame. That brings the benefits of easy manufacturing, easy installation and low cost.

A further object of the present invention is to conceal the hinge elements from outside view, preventing tampering when the door is closed.

A further object of the present invention is to eliminate the unaesthetic look of the hinges those are visible from outside.

A further object of the present invention is to allow the door to be opened up to 225 degree angle relative to door frame.

A further object of the present invention is to allow the door to be placed inside the door frame or outside of the door frame.

To achieve the above and other objects the present invention introduces a mechanism that provides guided swinging movement to allow the door to rotate about the vertical axis and at the same time move the door away from the door frame slightly to create a clear path for the rotation.

According to present invention the concealed hinge mechanism consists of two fixed plates, each having a vertical knuckle at one end, an upper and a lower track horizontally extending end to end. The plates are fastened on the door and door frame to support connecting elements and the weight of the door.

According to another aspect of the present invention, the concealed hinge mechanism further comprises two connecting elements to connect fixed plates and provide the said guided swinging movement. The connecting elements designed in L shape with a short plate and a long plate, having a knuckle at the end of the short plate end to be connected to the fixed plate, a hole at the apex to connect connecting elements to each other and laterally extending pins for engaging the upper track and the lower track of the fixed plates.

According to the present invention, in the closed position the connecting elements are at 45 degree angle relative to the door and door frame; and the door is at 90 degree angle relative to door frame. When a force is applied to open the door the connection elements' apexes moves away from the door and door frame until the angle reaches 90 degree which moves the door away from door frame to create a clear path while rotating.

Over 90 degree angle the door starts moving towards the door frame on the horizontal axis to complete the opening movement. The mechanism of the present invention is described in greater clarity by the drawings.

DETAILED DESCRIPTION OF THE INVENTION

Figure 1:
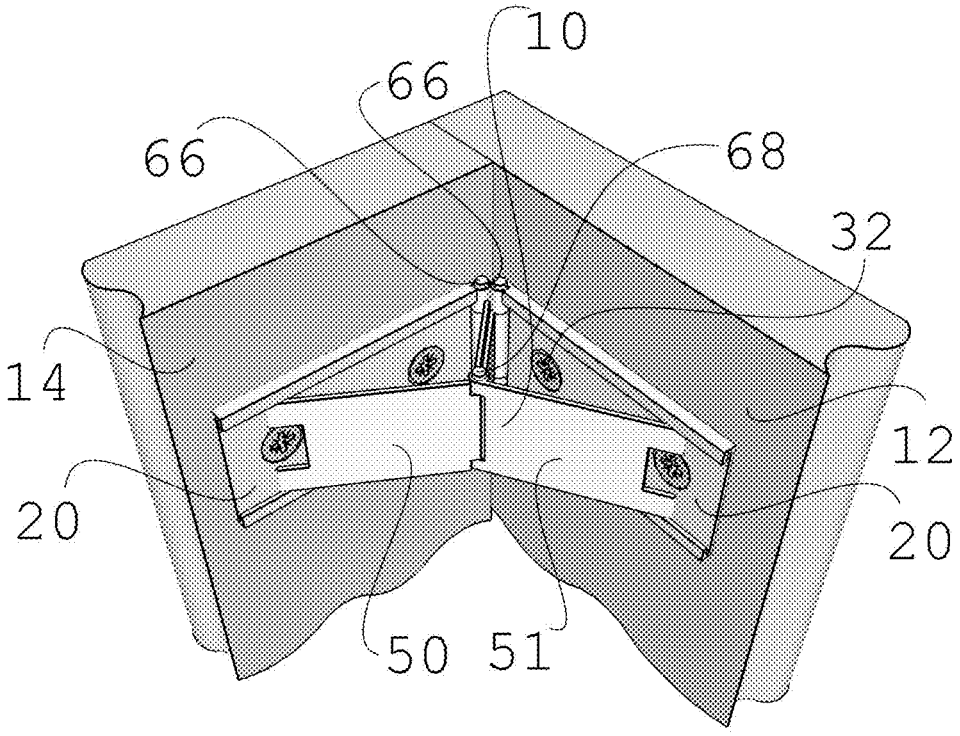
FIG. 1 is a perspective view of the concealed hinge mechanism fixed to the door and the door frame in closed position.

In accordance with the principles of the present invention, referring to FIG. 1, there is depicted the door 12 and the door frame 14 connected by the concealed hinge mechanism 10 in closed position. The door 12 is depicted as placed outside of the door frame 14. The concealed hinge mechanism 10 comprises the first fixed plate 20 fastened to the door frame 14 and the second fixed plate 20 fastened to the door 12. The first fixed plate 20 and the second fixed plate 20 are connected to each other with two connecting elements: the first L-shaped connecting element 50 and the second L-shaped connecting element 51.

Figure 2:
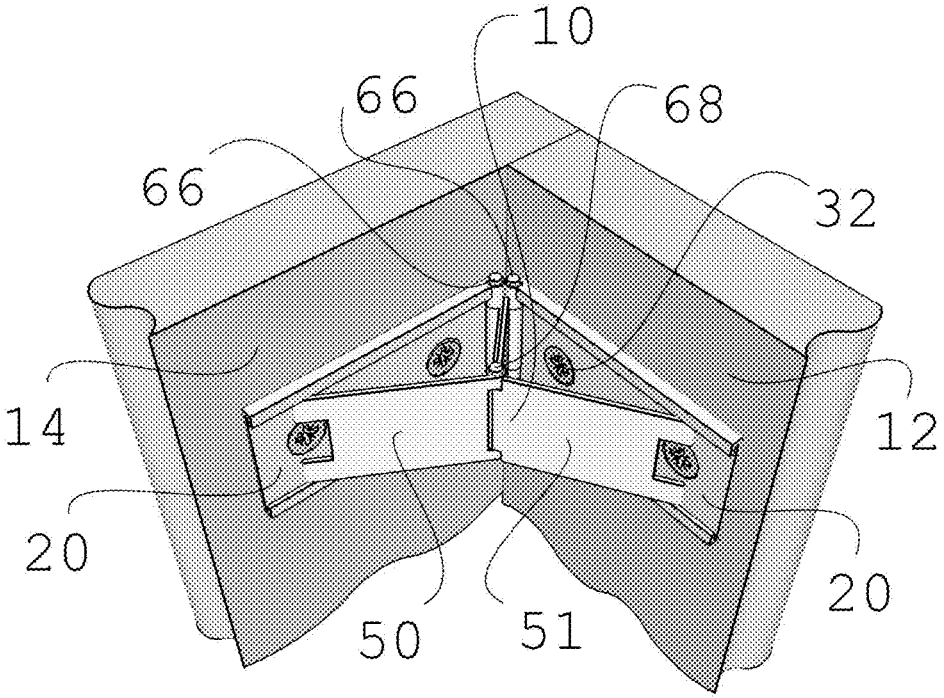
FIG. 2 is a perspective view of the concealed hinge mechanism fixed to the door and the door frame in closed position in accordance.

Referring to FIG. 2, there is depicted the door 12 placed inside of the door frame 14 in closed position and connected by the concealed hinge mechanism 10.

Figure 3:
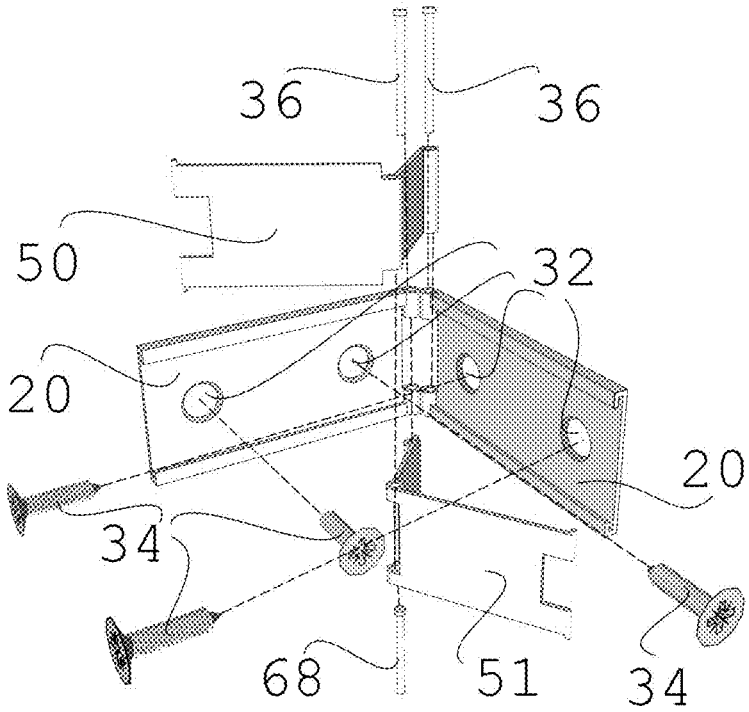
FIG. 3 is an exploded perspective view of the concealed hinge mechanism of FIG. 1 and FIG. 2.

Referring to FIG. 3, the concealed hinge mechanism 10 depicted in an exploded perspective, further showing the details of the present invention. As shown in FIG. 3, there may be fasteners 34, such as screws, which go through the apertures 32, to affix the fixed plates 20 to the door 12 or door frame 14. The concealed hinge mechanism 10 allows the door 12 to be placed outside of the door frame 14 and opened up to a 225 degree angle DA relative to door frame 14, starting at a 90 degree angle DA closed position. Several angles of the rotational and outward movement depicted in figures FIG. 4, FIG. 5, FIG. 6 and FIG. 7 as examples.

Figure 4:
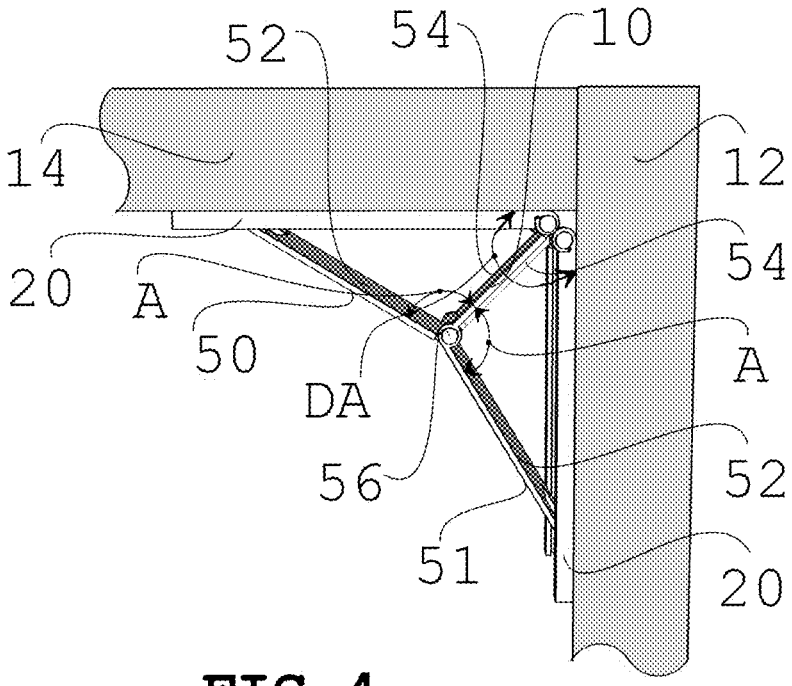
FIG. 4 is a top view of the concealed hinge mechanism of FIG. 1 in closed position.

Referring to FIG. 4, the door 12 and the door frame 14 depicted in 90 degree angle DA closed position connected by the concealed hinge mechanism 10. The short plates 54 of the connecting elements 50 and 51 are at 45 degree angle relative to the door 12 and the door frame 14.

Figure 5:
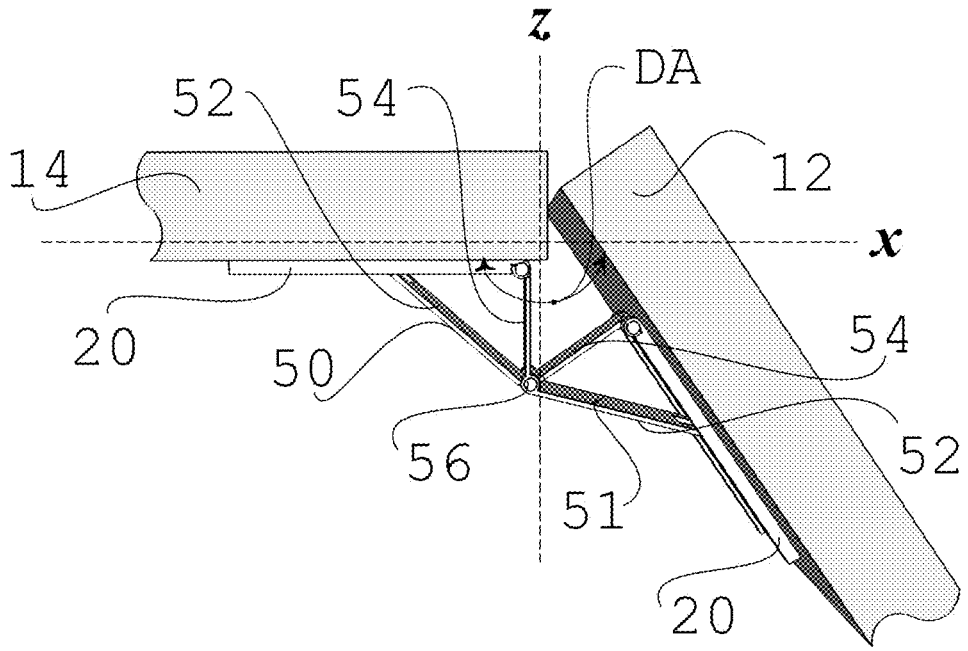
FIG. 5 is a top view of the concealed hinge mechanism of FIG. 1 in 45 degree opened position.

Referring to FIG. 5, the door 12 is shown in open position, at the angle DA of 135 degree relative to the door frame. Now the shorter second plate 54 of the second L-shaped connecting element 51 is at 90 degree angle relative to the door frame 14, moving the apex 56 of the second L-shaped connecting element 51 away from the door frame 14 and moving the door 12 away from the door frame 14 on the z axis. The shorter second plate 54 of the first L-shaped connecting element 50 is at 90 degree angle with the door 12, moving the apex 56 of the first L-shaped connecting 50 element away from the door 12 and moving the door 12 outward on the x axis. The longer first plate 52 of the L-shaped connecting elements 50 and 51 slid inward, forcing the door 12 to rotate outward.

Figure 6:
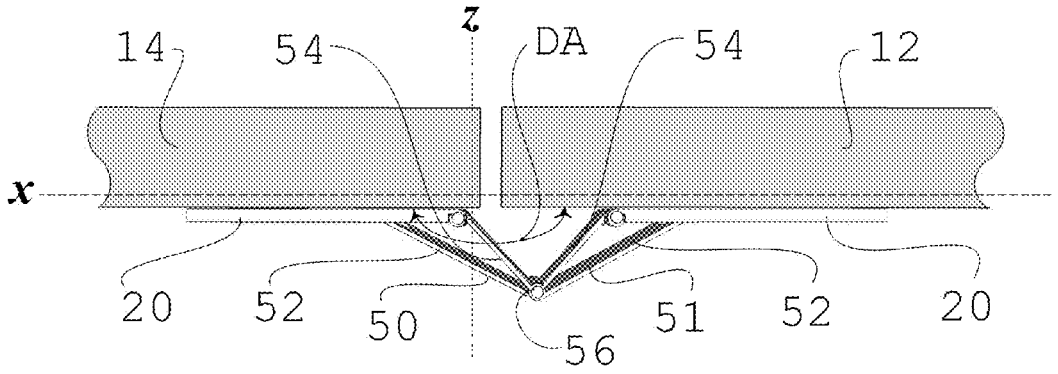
FIG. 6 is a top view of the concealed hinge mechanism of FIG. 1 in 90 degree opened position.

Referring to FIG. 6, the door 12 is shown in open position, at the angle DA of 180 degree relative to the door frame. The shorter second plate 54 of the second L-shaped connecting element 51 is at 135 degree angle relative to the door frame 14, pulling the apex 56 of the second L-shaped connecting element 51 toward the door frame 14 and pulling the door 12 toward the door frame 14 on z axis. The shorter second plate 54, of the first L-shaped connecting element 50 is at 135 degree angle with the door 12, pulling the apex 56 of the first L-shaped connecting 50 element toward the door 12 and moving the door 12 further outward on the x axis. The longer first plate 52 of the L-shaped connecting elements 50 and 51 slid further inward, forcing the door 12 to rotate further outward.

Figure 7:
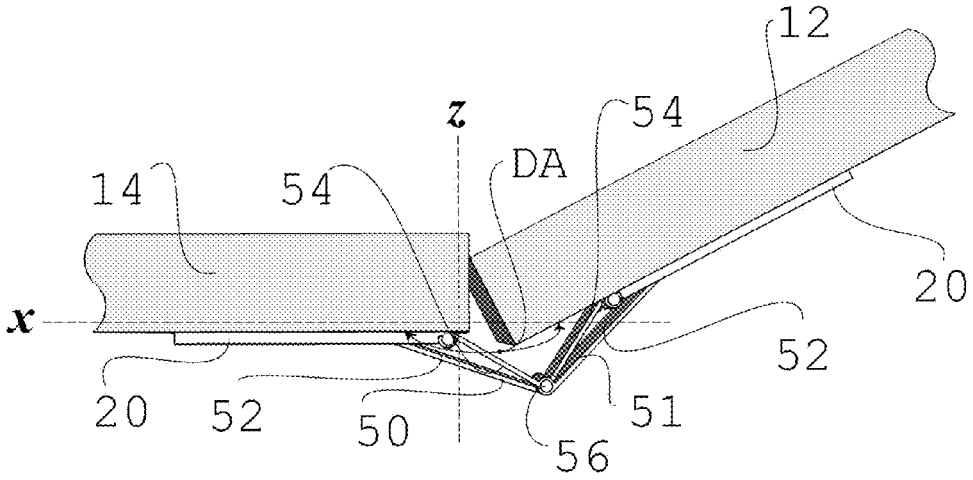
FIG. 7 is a top view of the concealed hinge mechanism of FIG. 1 in 110 degree opened position.

Referring to FIG. 7, the door 12 is shown in open position, at the angle DA of 200 degree relative to the door frame. The shorter second plate 54, of the second L-shaped connecting element 51 is at 155 degree angle relative to the door frame 14, pulling the apex 56 of the second L-shaped connecting element 51 toward the door frame 14 and moving the door 12 away from the door frame 14 on z axis. The shorter second plate 54, of the first L-shaped connecting element 50 is at 155 degree angle with the door 12, pulling the apex 56 of the first L-shaped connecting 50 elements toward the door 12 and moving the door 12 inward on x axis. The longer first plate 52 of the L-shaped connecting elements 50 and 51 slid further inward, forcing the door 12 to rotate further outward.

The concealed hinge mechanism 10 allows the door 12 to be placed inside of the door frame 14 and opened up to 225 degree angle relative to door frame 14, starting at 90 degree angle closed position. Several angles of the rotational and outward movement depicted in figures FIG. 8, FIG. 9, FIG. 10 and FIG. 11 as examples.

Figure 8:
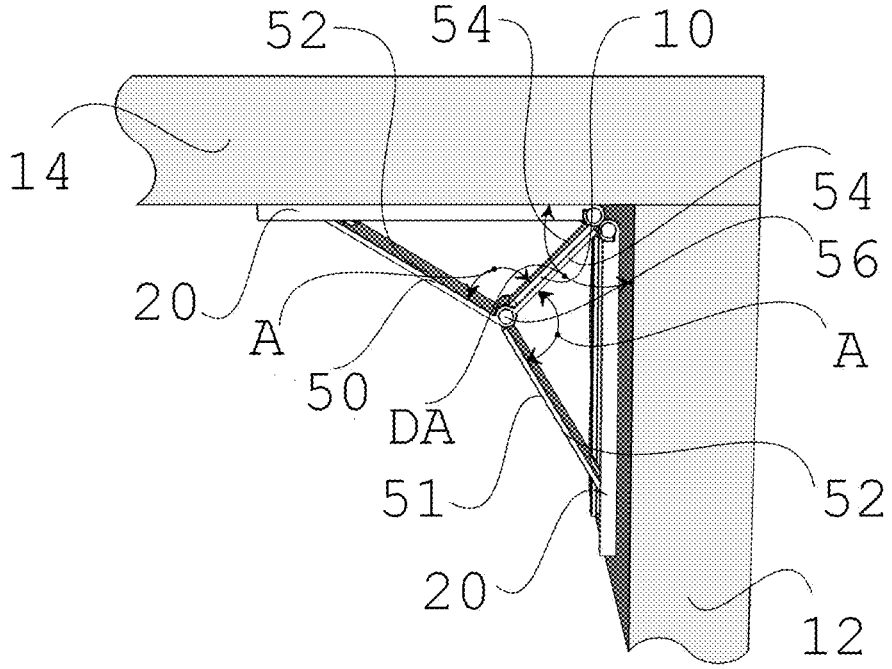
FIG. 8 is a top view of the concealed hinge mechanism of FIG. 2 in closed position.

Referring to FIG. 8, the door 12 and the door frame 14 depicted in 90 degree angle DA closed position connected by the concealed hinge mechanism 10. The short plates 54 of the connecting elements 50 and 51 are at 45 degree angle relative to the door 12 and the door frame 14.

Figure 9:
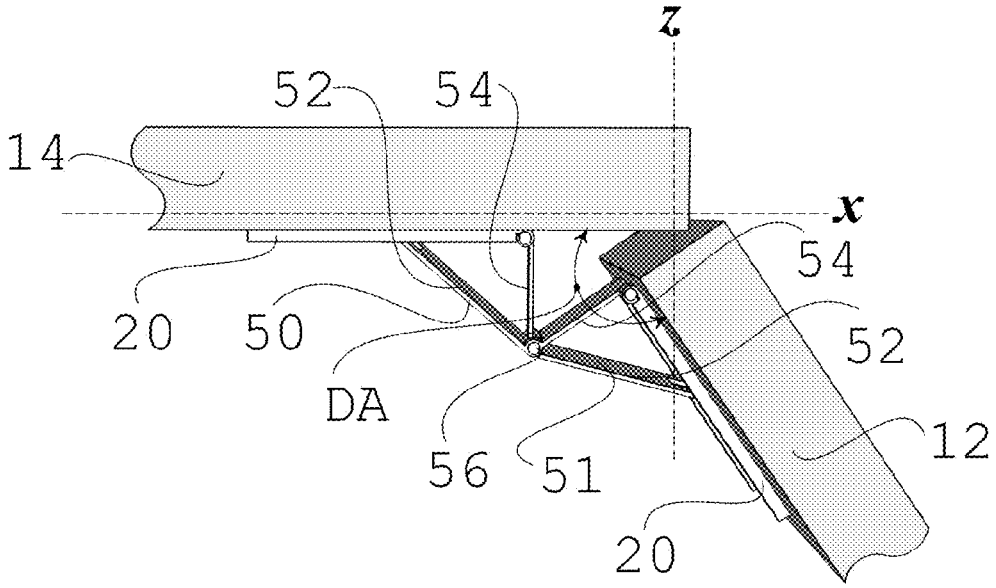
FIG. 9 is a top view of the concealed hinge mechanism of FIG. 2 in 45 degree opened position.

Referring to FIG. 9, the door 12 is shown in open position, at the angle DA of 135 degree relative to the door frame. Now the shorter second plate 54 of the second L-shaped connecting element 51 is at 90 degree angle relative to the door frame 14, moving the apex 56 of the second L-shaped connecting element 51 away from the door frame 14 and moving the door 12 away from the door frame 14 on the z axis. The shorter second plate 54 of the first L-shaped connecting element 50 is at 90 degree angle with the door 12, moving the apex 56 of the first L-shaped connecting 50 element away from the door 12 and moving the door 12 outward on the x axis. The longer first plate 52 of the L-shaped connecting elements 50 and 51 slid inward, forcing the door 12 to rotate outward.

Figure 10:
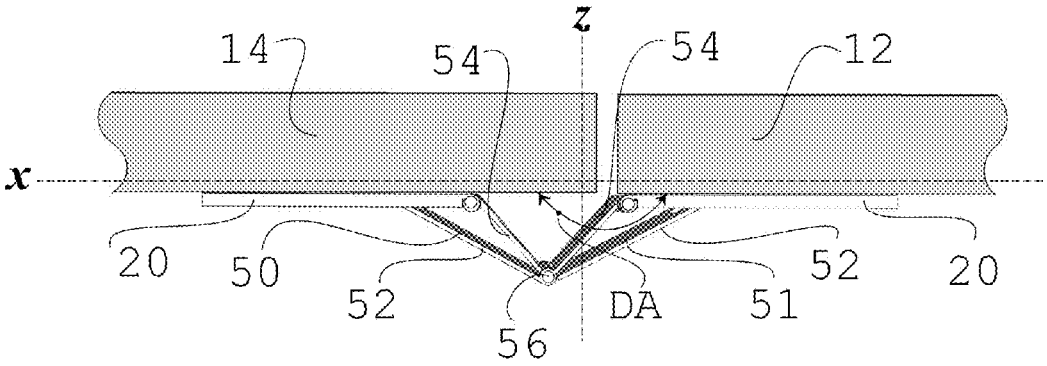
FIG. 10 is a top view of the concealed hinge mechanism of FIG. 2 in 90 degree opened position.

Referring to FIG. 10, the door 12 is shown in open position, at the angle DA of 180 degree relative to the door frame. The shorter second plate 54 of the second L-shaped connecting element 51 is at 135 degree angle relative to the door frame 14, pulling the apex 56 of the second L-shaped connecting element 51 toward the door frame 14 and pulling the door 12 toward the door frame 14 on the z axis. The shorter second plate 54, of the first L-shaped connecting element 50 is at 135 degree angle with the door 12, pulling the apex 56 of the first L-shaped connecting 50 element toward the door 12 and moving the door 12 further outward on the x axis. The longer first plate 52 of the L-shaped connecting elements 50 and 51 slid further inward, forcing the door 12 to rotate further outward.

Figure 11:
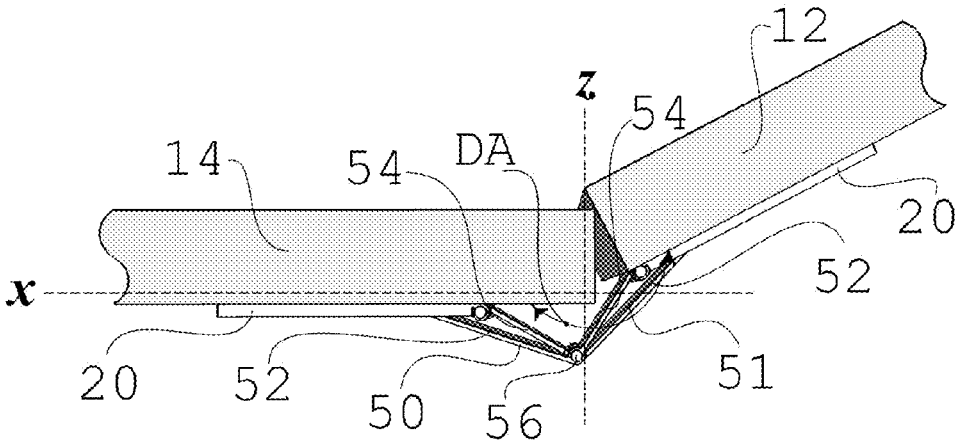
FIG. 11 is a top view of the concealed hinge mechanism of FIG. 2 in 110 degree opened position.

Referring to FIG. 11, the door 12 is shown in open position, at the angle DA of 200 degree relative to the door frame. The shorter second plate 54, of the second L-shaped connecting element 51 is at 155 degree angle relative to the door frame 14, pulling the apex 56 of the second L-shaped connecting element 51 toward the door frame 14 and moving the door 12 away from the door frame 14 on the z axis. The shorter second plate 54, of the first L-shaped connecting element 50 is at 155 degree angle with the door 12, pulling the apex 56 of the first L-shaped connecting 50 elements toward the door 12 and moving the door 12 inward on the x axis. The longer first plate 52 of the L-shaped connecting elements 50 and 51 slid further inward, forcing the door 12 to rotate further outward.

Figure 12:
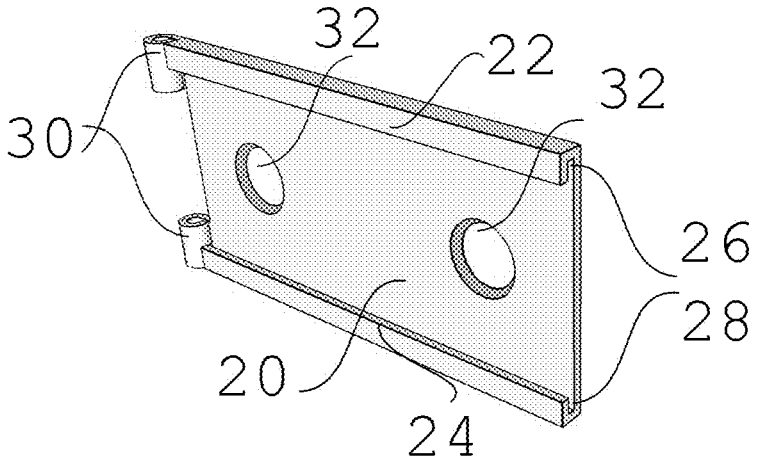
FIG. 12 is a perspective view of the fixed plate, isolated from the surrounding elements.

Referring to FIG. 12, the fixed plates 20 are made of a sturdy metal, having apertures 32 to be fastened on the door 12 and the door frame 14. The fixed plates 20 have vertical first knuckle 30 at one end. The upper edge 22 and the lower edge 24 are folded inwardly to form the upper track 26 and the lower track 28 extending horizontally end to end and opposing each other. According to the present invention the two fixed plates 20 are identically constructed.

Figure 13:
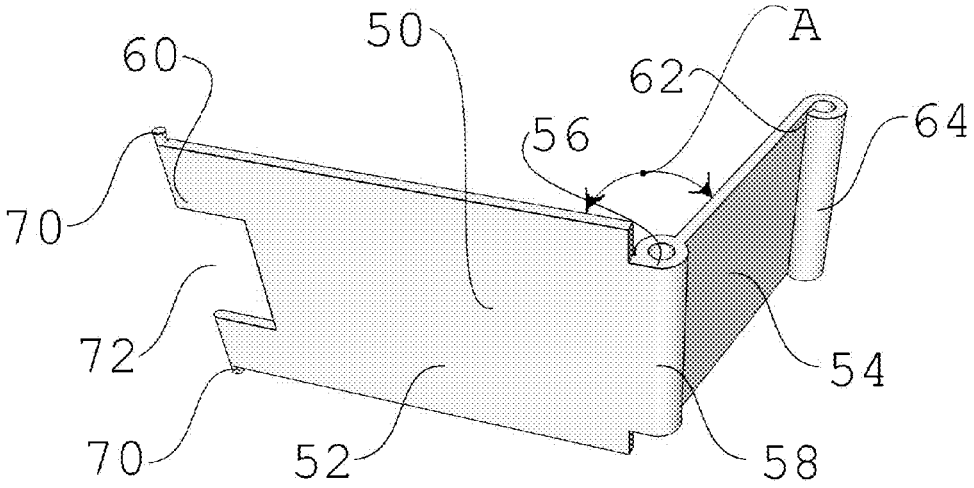
FIG. 13 is a perspective view of the first L-shaped connecting element, isolated from the surrounding elements.

Referring now to FIG. 13, the first connecting element 50 constructed in L shape and made of a sturdy metal, consists of a longer first plate 52 and a shorter second plate 54 connected at the apex 56 at 110 degree angle A. The first end 60 of the first plate 52 having laterally extending pins 70 and a notch 72 shaped to pass over the apertures 32 without interference. The second end 62 of the second plate 54 having a second knuckle 64. The first connecting element 50 has the interlocking knuckle 58 at the apex 56 shaped to engage one or more interlocking knuckles 58 at the apex of the second connecting element 51.

Figure 14:
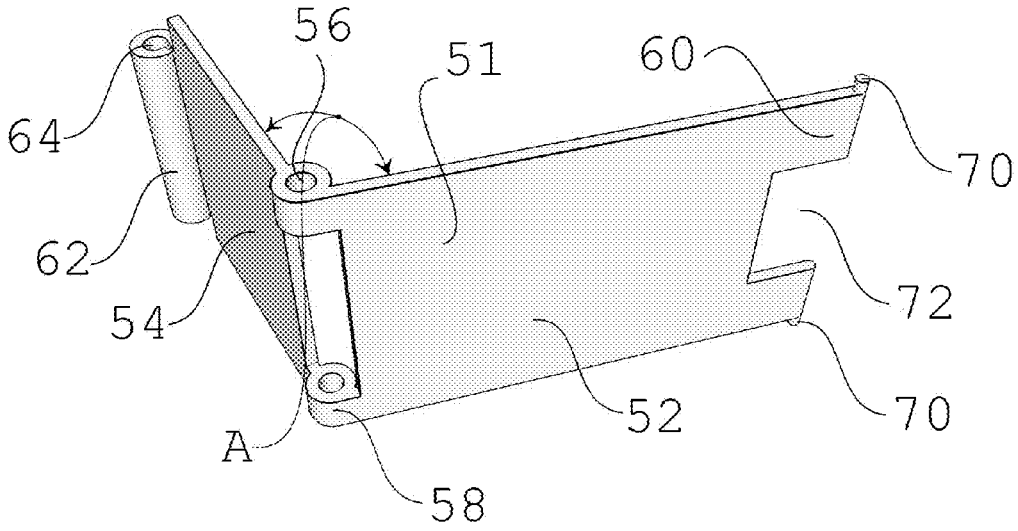
FIG. 14 is a perspective view of the second L-shaped connecting element, isolated from the surrounding elements.

Referring to FIG. 14, the second connecting element 51 constructed in L shape and made of a sturdy metal, consists of a longer first plate 52 and a shorter second plate 54 connected at the apex 56 at 110 degree angle A. The first end 60 of the first plate 52 having laterally extending pins 70 and a notch 72 shaped to pass over the apertures 32 without interference. The second end 62 of the second plate 54 having a second knuckle 64. The second connecting element 50 has the interlocking knuckle 58 at the apex 56 shaped to engage one or more interlocking knuckles 58 at the apex of the first connecting element 50

Figure 15:
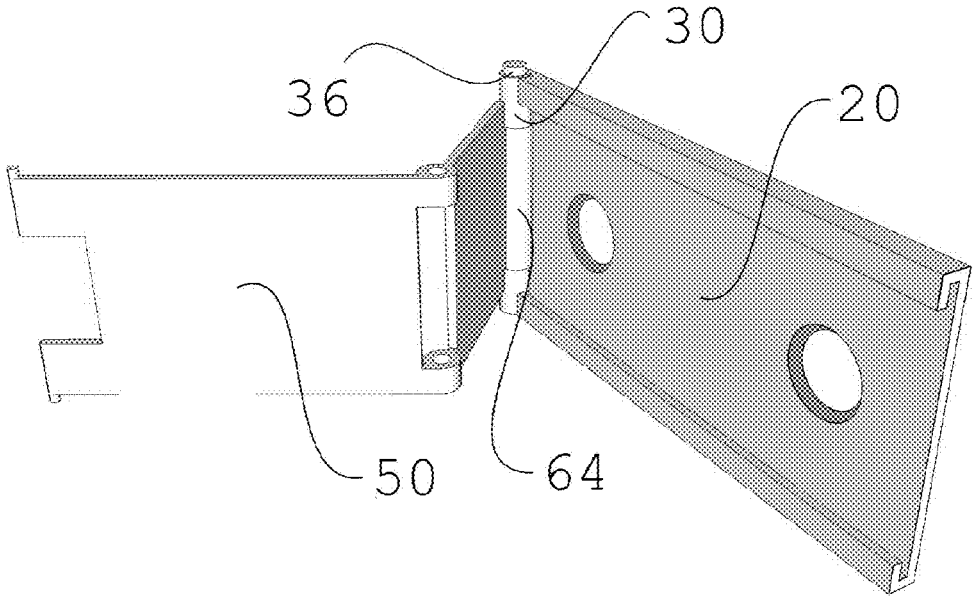
FIG. 15 is an assembled view of the first L-shaped connecting element and the second fixed plate connected by the first hinge pin, isolated from the surrounding elements.

Referring to FIG. 15, the first L-shaped connecting element 50 is shown pivotally connected to the fixed plate 20 by inserting the first pin 36 in the knuckle 64 of the first connecting element 50 and the first knuckle 30 of the fixed plate 20.

Figure 16:
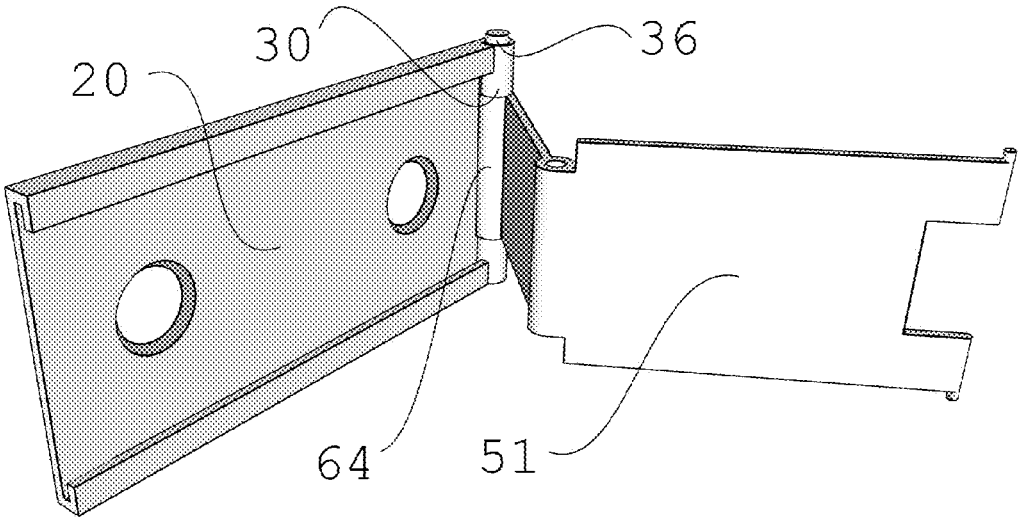
FIG. 16 is an assembled view of the second L-shaped connecting element and the first fixed plate connected by the first hinge pin, isolated from the surrounding elements.

Referring to FIG. 16, the second L-shaped connecting element 51 is shown pivotally connected to the fixed plate 20 by inserting the first pin 36 in the knuckle 64 of the second connecting element 51 and the first knuckle 30 of the fixed plate 20.

Figure 17:
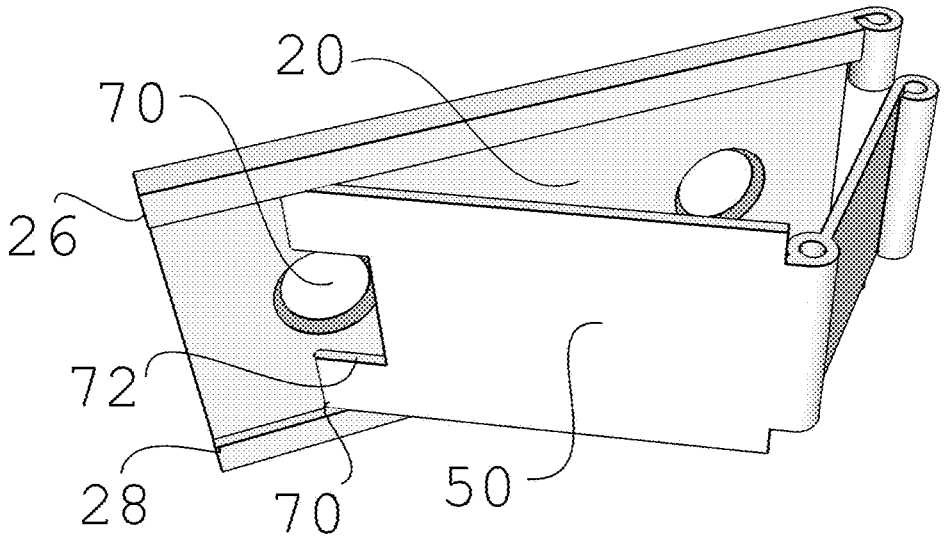
FIG. 17 is a perspective view of the laterally extending pins of the first connecting element, engaging the upper track and the lower track of the first fixed plate.

Referring to FIG. 17, to provide horizontal sliding back and forth, the laterally extending pins 70 of the first L-shaped connecting element 50 are placed in the upper track 26 and lower track 28 of the fixed plate 20. The notch 72 passes over the apertures 32 without interference.

Figure 18:
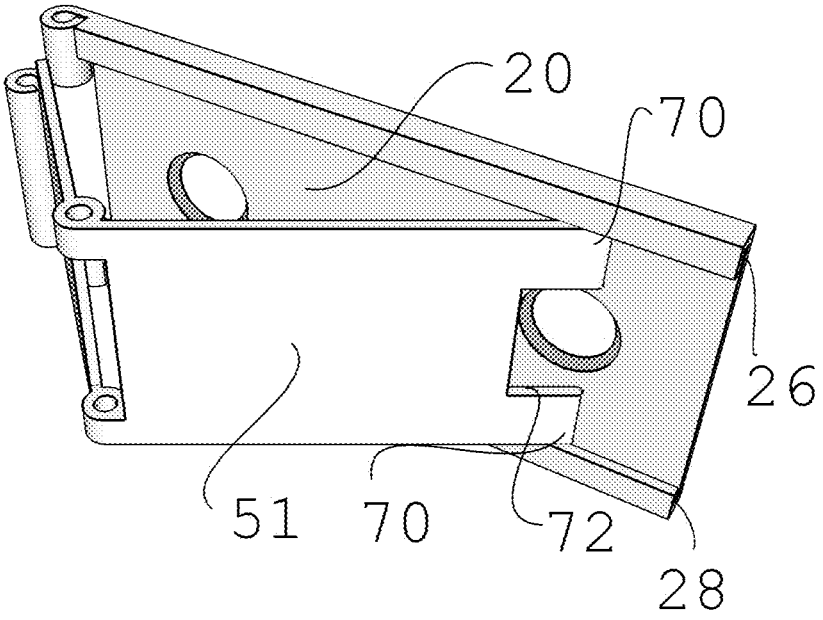
FIG. 18 is a perspective view of the laterally extending pins of the second connecting element, engaging the upper track and the lower track of the second fixed plate.

Referring to FIG. 18, to provide horizontal sliding back and forth, the laterally extending pins 70 of the second L-shaped connecting element 51 are placed in the upper track 26 and lower track 28 of the fixed plate 20. The notch 72 passes over the apertures 32 without interference.

Figure 19:
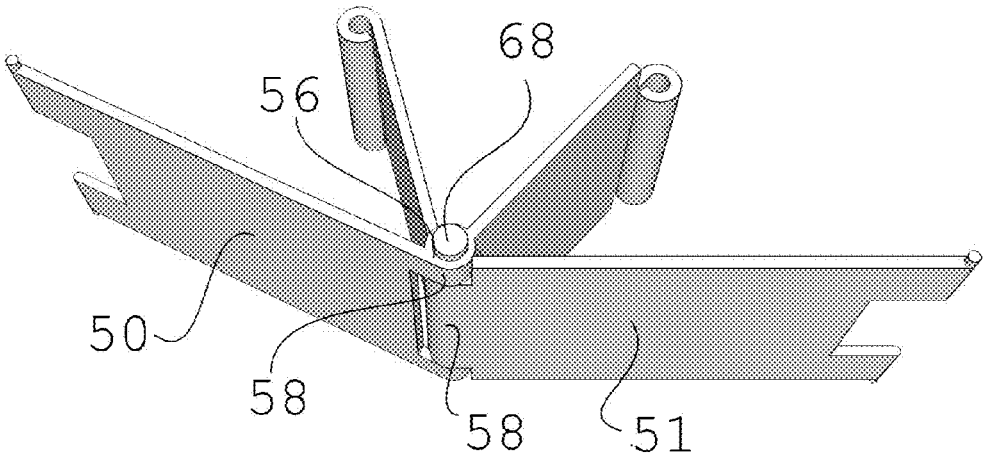
FIG. 19 is assembled view of the first connecting element and second connecting element, connected the interlocking knuckles at the apexes by the second pin.

Referring to FIG. 19, the first L-shaped connecting element 50 is operably connected to the second L-shaped connecting element 51 at their apexes 56 by the second hinge pin 68. The second pin 68 holds the interlocking knuckles 58 together and allow the apexes 56 to rotate relative to each other. This forms a pivotal connecting hinge connecting the apexes 56 of the pair of connecting elements 50, 51.

As defined in the present application, the term 'about' is defined to have an uncertainty of +/−5%, according to expected variations in manufacturing and constructions. For example, "about 100 degrees" indicates a range from 95-105 degrees.

What is claimed is:

1. A concealed hinge mechanism for connecting a door and a door frame, having a door angle between them, the concealed hinge mechanism comprising:

two fixed plates, each of the fixed plates comprising:

an upper edge having an upper track;

a lower edge having a lower track opposed to the upper track;

a first knuckle connected to each of the fixed plates;

a pair of apertures through the fixed plate between the upper and lower edges; and fasteners for fitting through the apertures for fastening one of the fixed plates to the door and the other fixed plate to the door frame; and a pair of connecting elements, each of the connecting elements comprising:

a longer first plate and a shorter second plate connected at an apex at an angle;

a first end of the first plate having laterally extending pins for engaging the upper track and the lower track of one of the fixed plates;

a second end of the second plate having a second knuckle;

a first pin for hingably connecting the first knuckle and the second knuckle; and a pivotal connecting hinge connecting the apexes of the pair of connecting elements.

2. The concealed hinge mechanism of claim 1, wherein the pivotal connecting hinge has one or more interlocking knuckles at the apex of one of the connecting elements, shaped to engage one or more interlocking knuckles at the apex of the other connecting element, wherein the interlocking knuckles are operably connected to each other by a second pin to hold the interlocking knuckles together and allow the apexes to rotate relative to each other.

3. The concealed hinge mechanism of claim 1, wherein the first plate of the connecting elements each have a notch shaped to pass over the aperture without interference.

4. The concealed hinge mechanism of claim 1, wherein the angle is selected to limit the door angle to between 90 and 180 degrees.

5. The concealed hinge mechanism of claim 1, the angle is selected to limit the door angle to between 90 and 225 degrees.

6. The concealed hinge mechanism of claim 1, wherein the angle is about 110 degrees.

* * * * *